US007353755B2

(12) United States Patent
Aumasson et al.

(10) Patent No.: US 7,353,755 B2
(45) Date of Patent: Apr. 8, 2008

(54) DECONFINEMENT DEVICE FOR THE CASING OF A PIECE OF AMMUNITION

(75) Inventors: Régis Aumasson, Bourges (FR); Dominique Dion, Bourges (FR); Sylvain Jayet, Bourges (FR)

(73) Assignee: Giat Industries, Versailles (FR)

( * ) Notice: Subject to any disclaimer, the term of this patent is extended or adjusted under 35 U.S.C. 154(b) by 363 days.

(21) Appl. No.: 11/006,740

(22) Filed: Dec. 8, 2004

(65) Prior Publication Data

US 2006/0027126 A1 Feb. 9, 2006

(30) Foreign Application Priority Data

Dec. 22, 2003 (FR) ..... 03 15338

(51) Int. Cl.
*F42B 39/20* (2006.01)
*F42B 12/20* (2006.01)

(52) U.S. Cl. ..... 102/481; 102/501

(58) Field of Classification Search ..... 102/473, 102/481, 382, 439, 501
See application file for complete search history.

(56) References Cited

U.S. PATENT DOCUMENTS 4,004,516 A 1/1977 Johnson et al.
4,991,513 A 2/1991 Malamas et al.
5,035,180 A * 7/1991 Purcell et al. ..... 102/481
5,035,182 A * 7/1991 Purcell et al. ..... 102/481
5,487,561 A * 1/1996 Mandzy et al. ..... 280/741
5,939,662 A * 8/1999 Bootes et al. ..... 102/473
6,523,477 B1 * 2/2003 Brooks et al. ..... 102/481
6,952,995 B2 * 10/2005 Friedlander, III ..... 102/481
7,107,909 B2 * 9/2006 Haeselich ..... 102/470

FOREIGN PATENT DOCUMENTS

| | | | |
|---|---|---|---|
| DE | 2131748 | A | 12/1972 |
| EP | 0 977 005 | A1 | 2/2000 |
| EP | 1 275 930 | A1 | 1/2003 |
| FR | 2627272 | A1 * | 8/1989 |
| FR | 2686410 | A1 * | 7/1993 |
| WO | WO 00/58685 | A2 | 10/2000 |

* cited by examiner

*Primary Examiner*—James S Bergin
(74) *Attorney, Agent, or Firm*—Oliff & Berridge, PLC

(57) ABSTRACT

A deconfinement device for the casing of a piece of ammunition enclosing an explosive load able to be ignited by a priming fuse, device including at least one vent enabling the explosive load to communicate with the free air, device where the vent opens into a chamber located between the fuse and the explosive load.

8 Claims, 2 Drawing Sheets

DECONFINEMENT DEVICE FOR THE CASING OF A PIECE OF AMMUNITION

BACKGROUND OF THE INVENTION

1. Field of Invention

The technical scope of the invention is that of devices ensuring the deconfinement of an ammunition casing enclosing an explosive load.

2. Description of Related Art

Deconfinement devices enable the detonation of a shell to be prevented further to, for example, heating during a fire.

When an explosive load is heated, its decomposition generates gases that are trapped inside the shell casing.

The pressure builds up heavily leading to the detonation of the shell.

It is known to provide deconfinement devices that enable the gases to be evacuated out of the shell so as to prevent this build up of pressure and subsequent detonation.

Patent DE2131748 thus describes a closing plug that is installed when the shell is in storage. This plug incorporates a closing plate connected by a fusible material. The increase in temperature releases the plate thereby enabling the gases to be evacuated.

However, such deconfinement means may only be implemented during the storage phase of the ammunition, phase during which the fuse is removed.

Such protection is, however, currently being sought for a shell fitted with its priming fuse.

In this case, heating can lead either to the actual ignition of the load itself as a result of the pressure build up, or to the ignition of the fuse which also leads to the detonation of the explosive load.

SUMMARY OF THE INVENTION

The aim of the invention is to propose a deconfinement device providing protection, in a simple manner, against accidental ignitions that are due either to the heating of the fuse or that of the explosive load itself.

The deconfinement device according to the invention also provides protection when the fuse is not mounted in the ammunition.

Thus, the invention relates to a deconfinement device for the casing of a piece of ammunition enclosing an explosive load able to be ignited by a priming fuse, device comprising at least one vent enabling the explosive load to communicate with the free air, device wherein the vent opens into a chamber located between the fuse and the explosive load.

According to one particular embodiment, the vent is made in a ring linking the casing and the priming fuse, ring delimiting the inner chamber inside which the vent opens out, said chamber being closed on the explosive load side by a bottom forming a plate able to be projected onto the explosive load during ignition of the fuse.

The bottom may incorporate at least one circular groove ensuring a reduction in its thickness and, preferably, at least two concentric circular grooves.

The linking ring may have threading enabling it to be connected to the casing and internal threading allowing it to be fastened to the fuse.

The vent may be blocked using a silicon plug.

BRIEF DESCRIPTION OF THE DRAWINGS

The invention will become more apparent from the following description of a particular embodiment, such description made in reference to the appended drawings, in which.

DETAILED DESCRIPTION OF PREFERRED EMBODIMENTS

Figure 1:
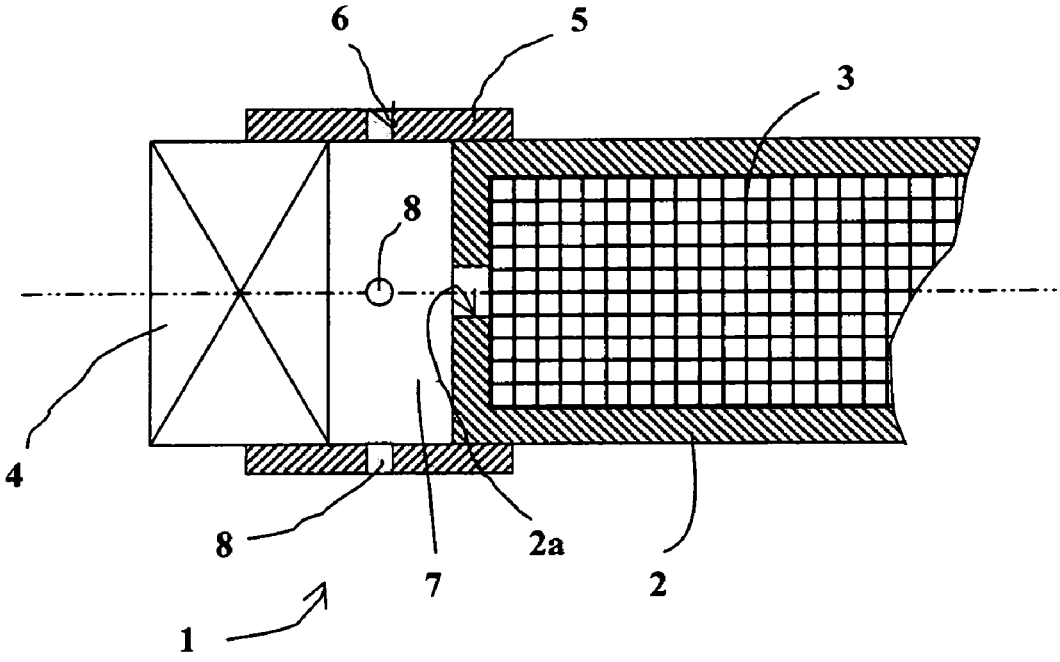
FIG. 1 is a partial schematic section of a piece of ammunition fitted with a device according to one embodiment of the invention.

With reference to FIG. 1, a piece of ammunition 1 comprises a casing 2 enclosing an explosive load 3 able to be primed through a hole 2*a* in the casing.

The explosive load 3 may be ignited by a priming fuse 4 made integral with the ammunition casing 2 by means of a linking ring 5. The joining means may, for example, incorporate internal threading on the inside of the ring 5 cooperating with threading on the casing 2 and fuse.

The priming fuse 4 is not shown in detail. Such components are classical and are well known to somebody skilled in the art.

The deconfinement device according to the invention comprises at least one vent 6 (here there are four vents evenly spaced angularly). The vents are made through the ring 5 and thus allow an inner chamber 7 delimited by the ring 5 to communicate with the exterior.

Each vent 6 is blocked by a plug 8 made of a material ensuring gastightness (for example silicon). This plug is made in a slightly conical shape and is set into position by elastic deformation.

In accordance with the invention, the vents 6 open out inside the ammunition 1 in the chamber 7 between the fuse 4 and explosive load 3.

Thus, a build up of pressure inside the chamber 7 causes the plugs 8, which offer little resistance to the gas pressure, to be ejected.

This ejection occurs whether the pressure build up is due to deterioration of the fuse 4 or to the degradation of the explosive load 3 itself.

The protection of the primed ammunition is thereby ensured using simple means.

Figure 2:
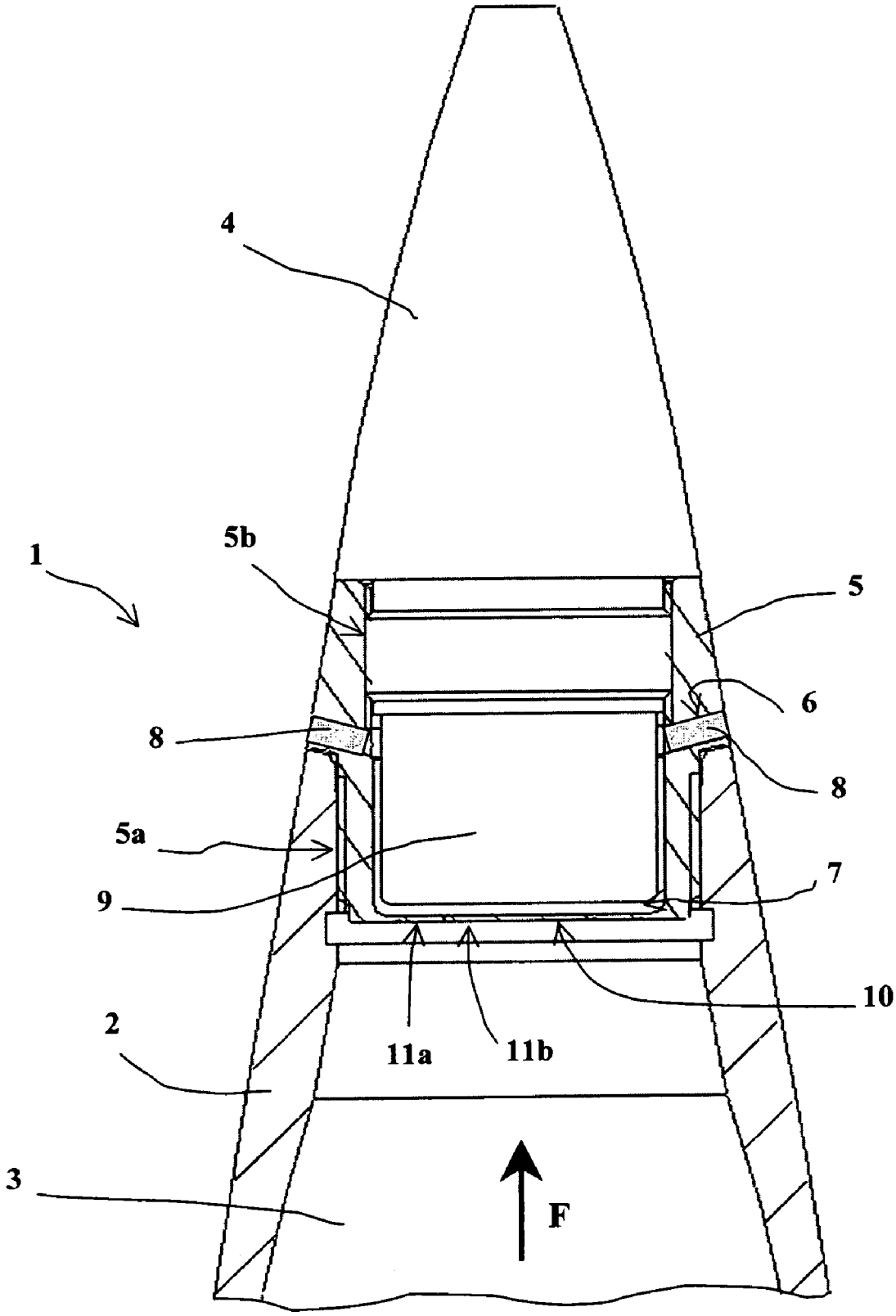
FIG. 2 is a partial longitudinal section of a piece of ammunition fitted with a device according to another embodiment of the invention.

FIG. 2 shows another embodiment of the invention.

In this embodiment, the ammunition 1 is an artillery shell. The fuse 4 is screwed onto a linking ring 5 that incorporates external threading 5*a* enabling it to be screwed onto the shell casing 2. The ring 5 also has internal threading 5*b* intended to receive the fuse 4.

According to this particular embodiment, the ring 5 delimits an inner chamber 7 in part occupied by a detonating relay 9 integral with the fuse 4.

This chamber 7 is closed on the explosive load 3 side by a bottom 10 forming a plate able to be projected onto the explosive load when the fuse 4 is ignited.

Figure 3:
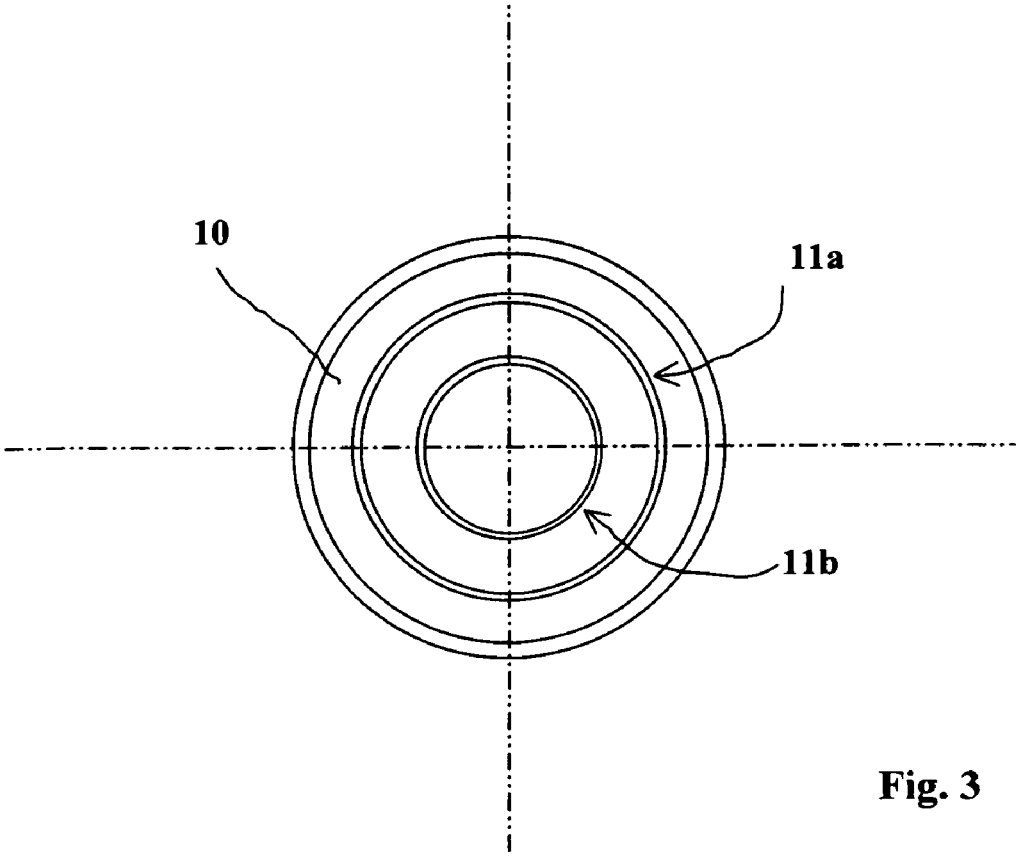
FIG. 3 is a view of the linking ring alone along the direction referenced F in FIG. 2.

The bottom 10 incorporates two concentric circular grooves 11*a* and 11*b* which may be seen more particularly in FIG. 3.

These grooves are obtained by machining one face of the bottom. They thus form two zones of reduced thickness in the bottom 10.

The ring 5 is made of steel. The thickness of the ring at its bottom 10 is about 1 mm.

The ignition of the fuse 4 leads to the cutting out of the bottom 10 around the groove 11*a* whose diameter is similar to that of the relay 9.

This results in the projection of this bottom onto the explosive load 3 thereby igniting it.

Such a closed linking ring forms the subject of patent EP0977005. The two grooves 11*a* and 11*b* allow the device to function perfectly, despite any variation in the radial and longitudinal positions of the priming of the fuse.

In accordance with the invention, the ring 5 also incorporates vents 6 blocked by silicon plugs 8. These vents allow the chamber 7 to communicate with the ammunition's exterior.

Thus, a build up of pressure inside the shell casing 2 will cause the bottom 10 to fracture around its grooves 11*a* or 11*b*. The gases will pass into the chamber 7 and will be evacuated through the vents 6, the silicon plugs offering little resistance to the gas pressure.

On the contrary, a build up of pressure in the chamber 7 due to the decomposition of the relay 9 of the fuse 4 will cause the plugs 8 to be expelled.

Note that the vents 6 do not perturb the normal functioning of the ammunition. Indeed, the kinetics of the detonation of the fuse 4 and its relay is much quicker than that of the decomposition of the relay corresponding to an increase in temperature.

The detonation of the relay 9 by the fuse 4 thus effectively causes the bottom 10 to be projected onto the explosive load 3 which is then ignited.

On the contrary, the thermal decomposition of the relay 9 simply causes the plugs 8 to be expelled, the deconfinement of the chamber 7 thus preventing the later detonation of the relay further to a build up of pressure in the chamber.

The deconfinement device according to the invention thus ensures the simple and reliable protection of a piece of ammunition fitted with a primer fuse.

Note that if the ammunition is stored with its fuse removed, deconfinement is ensured thanks to the presence of grooves 11*a* and 11*b*.

The build up of pressure in the shell casing will cause (as in the previous case for a primed shell) the opening of the bottom 10 along one of the grooves. The deconfinement of the shell is thus immediate, in the absence of a fuse, the chamber 7 is in fact open to the exterior.

By way of a variant, it is naturally possible for a different number of vents to be provided. The vents might be blocked using a different material to silicon, for example a material may be used which fuses at a given temperature increase (such as a eutectic alloy).

What is claimed is:

1. A deconfinement device for the casing of a piece of ammunition enclosing an explosive load able to be ignited by a priming fuse, said device comprising at least one vent enabling said explosive load to communicate with the free air, wherein said vent opens into an inner chamber located between said fuse and said explosive load, and said vent is blocked by an expellable plug.

2. A deconfinement device according to claim 1, wherein said vent is made in a ring linking said casing and said priming fuse, said ring delimiting said inner chamber inside which said vent opens out, said inner chamber being closed on said explosive load side by a bottom forming a plate able to be projected onto said explosive load during ignition of said fuse.

3. A deconfinement device according to claim 2, wherein said bottom incorporates at least one circular groove ensuring a reduction in its thickness.

4. A deconfinement device according to claim 3, wherein said bottom incorporates at least two concentric circular grooves.

5. A deconfinement device according to claim 4, wherein said linking ring is provided with a threading enabling it to be connected to said casing and an internal threading allowing its fastening to said fuse.

6. A deconfinement device according to claim 2, wherein said linking ring is provided with a threading enabling it to be connected to said casing and an internal threading allowing its fastening to said fuse.

7. A deconfinement device according to claim 6, wherein said vent is blocked by a silicon plug.

8. A deconfinement device according to claim 1, wherein said vent is blocked by a silicon plug.

* * * * *